US005311951A

United States Patent [19]

Kyte et al.

[11] Patent Number: 5,311,951

[45] Date of Patent: May 17, 1994

[54] METHOD OF MAINTAINING A BOREHOLE IN A STRATIGRAPHIC ZONE DURING DRILLING

[75] Inventors: David G. Kyte, Bedford; D. Nathan Meehan, Colleyville; Theodore R. Svor, Bedford, all of Tex.

[73] Assignee: Union Pacific Resources Company, Fort Worth, Tex.

[21] Appl. No.: 48,362

[22] Filed: Apr. 15, 1993

[51] Int. Cl.[5] ..... E21B 47/00

[52] U.S. Cl. ..... 175/40

[58] Field of Search ..... 175/26, 40, 45, 50; 166/250, 254, 255

[56] References Cited

U.S. PATENT DOCUMENTS

| | | | |
|---|---|---|---|
| 4,800,385 | 1/1989 | Yamazaki | 175/40 X |
| 4,854,397 | 8/1989 | Warren et al. | 175/26 |
| 5,010,527 | 4/1991 | Mahrer | 166/254 X |
| 5,189,415 | 2/1993 | Shimada et al. | 166/250 X |

OTHER PUBLICATIONS

"Acquiring and Interpreting Logs in Hori", *Oilfield Review*, vol. 2, No. 3, pp. 34–51.

"An example of Log Interpretation in Horizontal Wells", *The Log Analyst*, Mar.–Apr., 1992, pp. 85–95.

"The Challenge of Logging Horizontal Wells", *The Log Analyst*, Mar.–Apr., 1991, pp. 63–84.

*Primary Examiner*—Thuy M. Bui

*Attorney, Agent, or Firm*—Geoffrey A. Mantooth

[57] ABSTRACT

Directional drilling techniques allow a borehole to be drilled downwardly, horizontally and even upwardly. The present invention provides a method of navigating a borehole that can be drilled with directional drilling techniques. The direction in which the borehole is drilled is determined relative to a stratigraphic target zone. By so navigating, the borehole can enter the target zone and be extended inside of the target zone. First, an offset log is obtained. Then a log of the borehole is obtained. Correlation points along the lengths of the borehole are selected. At each correlation point, the true stratigraphic depth of the borehole is determined, using the offset log. Knowing the true stratigraphic depth of the borehole allows the location of the target zone relative to the borehole to be determined, wherein the direction that the next segment of the borehole should be drilled is determined.

7 Claims, 5 Drawing Sheets

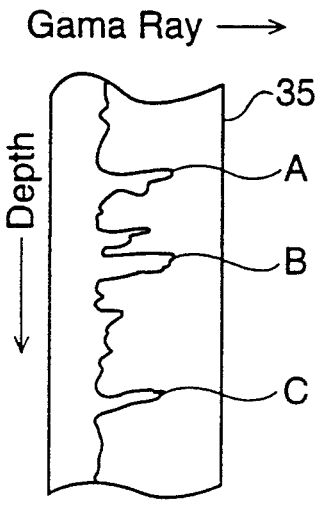
Fig. 2
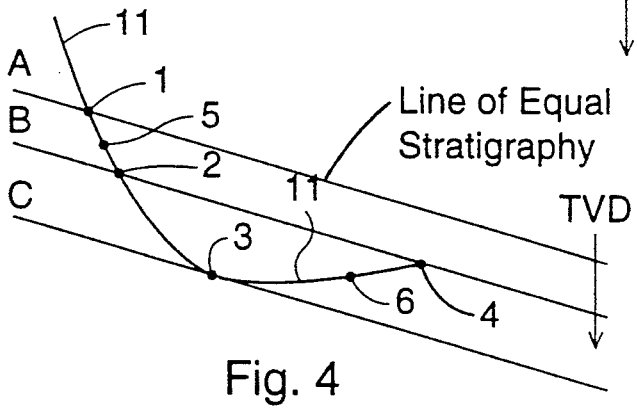
Fig. 4
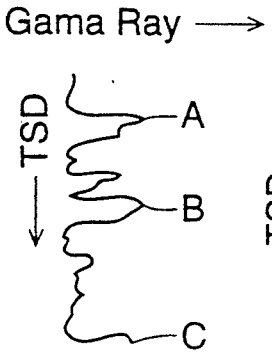
DOWN
Fig. 5A
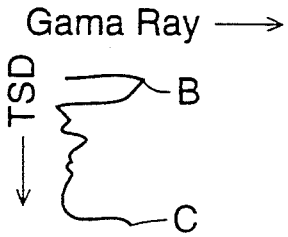
UP
Fig. 5B
Fig. 3
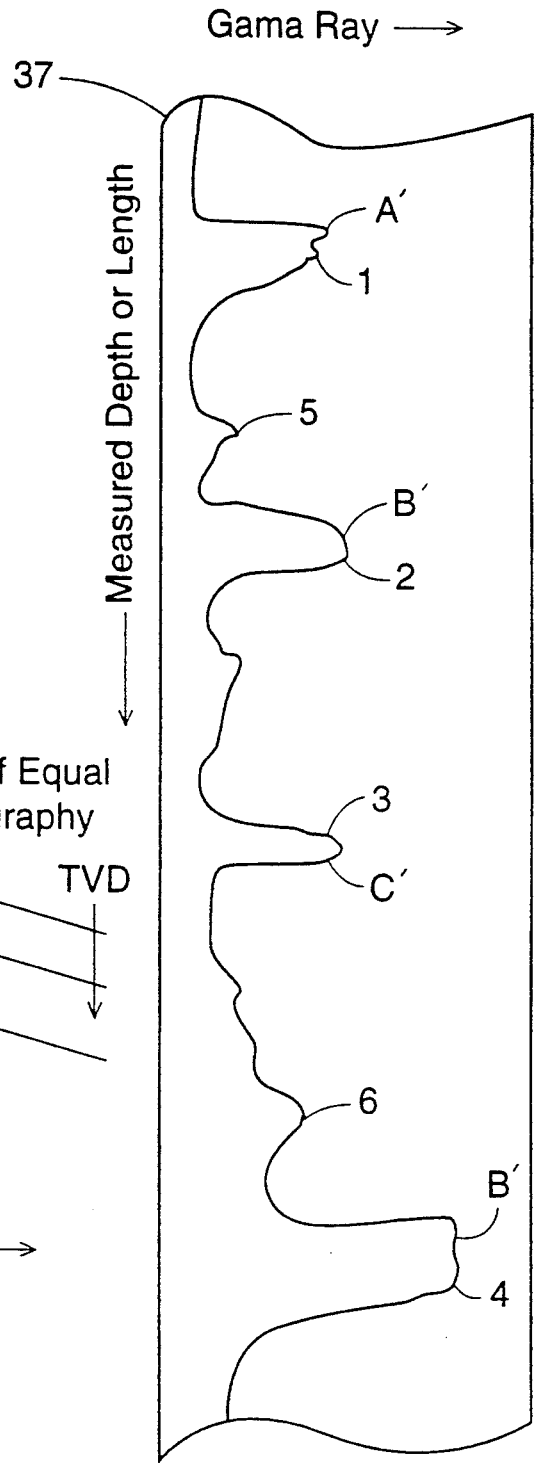

METHOD OF MAINTAINING A BOREHOLE IN A STRATIGRAPHIC ZONE DURING DRILLING

FIELD OF THE INVENTION

The present invention relates to drilling boreholes in the earth such as for the extraction of oil and natural gas, and in particular to drilling boreholes using directional drilling techniques.

BACKGROUND OF THE INVENTION

Traditionally, drilling for oil and gas involved using a drill bit to drill boreholes that were straight and more or less vertical. As their skill and equipment improved, drillers found that they could deviate from a straight path to form a curved borehole. One application of the somewhat limited directional drilling techniques allowed plural boreholes to be drilled from a small location. For example, plural wells could be drilled through a leg of an offshore platform. Although the boreholes were very close to each other at the surface, the bottoms of the boreholes were separated in different locations of an oil reservoir or even in different reservoirs.

Improvements in directional drilling have allowed drillers to drill a borehole in just about whatever direction is required. A borehole can be truly horizontal, where it lies along a horizontal plane. A borehole can even be drilled upwardly towards the surface from a lower location. This type of drilling is referred to as horizontal drilling and has allowed production increases from oil fields once thought diminished or even exhausted.

Now that drilling techniques and equipment can locate a borehole along almost any orientation, the problem of navigating the borehole during drilling arises. Oil is typically located in thin stratigraphic zones. Ideally, the driller would like to tap into the stratigraphic zone of interest, or target zone, with a borehole that traverses inside of the zone for an extended distance. For example, if the target zone has a true horizontal orientation, then the borehole, when it penetrates into the zone, extends along the horizontal to stay within the zone.

Unfortunately, the prior art only provides hit or miss techniques in maintaining a borehole inside of a target zone. The target zone is typically thousands of feet below the surface and is, in many instances, only 5-20 feet thick. Furthermore, stratigraphic zones are typically inclined or dipped from a horizontal plane. Thus, the target zone is a difficult target in which to maintain the borehole during drilling operations. With prior art drilling techniques, it is difficult to navigate a borehole so as to stay within a target zone. A borehole drilled with prior art techniques quickly exits the zone because its direction is not parallel to that of the zone. What is needed is a method of navigating a borehole inside of a stratigraphic zone during drilling.

SUMMARY OF THE INVENTION

It is an object of the present invention to provide a method of navigating a borehole relative to a stratigraphic zone so that the borehole can be maintained inside of the zone during drilling.

The method of the present invention determines the location of a borehole relative to strata in the earth. The method provides information from the borehole, which information characterizes the strata. The method also provides characterizing information of the strata from an offset location. Then, the method compares the borehole characterizing information to the offset characterizing information to determine the location of selected points along the borehole relative to the strata.

Directional drilling techniques allow a borehole to be drilled in almost any direction that is desired. Prior art techniques are able to located a point in a borehole using X, Y and Z (true vertical depth) coordinates, as measured from a fixed reference point on the surface. However, the present invention locates the borehole using a fourth dimension, that of stratigraphic depth. Stratigraphy can be represented as lines of constant stratigraphic depth. As stratigraphic zones typically are dipped to the horizontal, determining the location of the borehole relative to the stratigraphic target zone allows the borehole to be maintained within the stratigraphic zone.

A log is provided from an offset well or borehole which is vertical and therefore undistorted with respect to true vertical depth and also to true stratigraphic depth. A log is provided from the borehole of interest. As the borehole extends horizontally, or some other non-vertical direction, the log becomes distorted with respect to true vertical depth. This distortion makes the determination of the borehole location relative to the target zone difficult. The method of the present invention rescales the borehole log to a scale representative to true stratigraphic depth. This rescaled log can then be compared to the offset log. The character of the two logs are compared to determine the location of the borehole relative to stratigraphy.

In one aspect of the present invention, the method further includes the step of directing extensions of the borehole using the location of the points relative to the strata. Thus, if real time processing is performed during drilling operations, the borehole can be directed or navigated through a target strata so as to stay within the target strata. Alternatively, the method can be used to process logging information after the borehole has been drilled, in which another borehole, branching off of the first borehole, may be drilled.

In still another aspect of the present invention, the characterizing information is in the form of gamma ray logs. Gamma ray logs provide information on stratigraphy and may be correlated to other logs, such as resistivity logs, to determine an oil bearing target zone. Thus, in an offset well, a resistivity log is used to identify an oil bearing target zone. A gamma ray log in the offset well identifies the stratigraphy containing the oil bearing zone.

BRIEF DESCRIPTION OF THE DRAWINGS

FIGS. 2 and 3 are schematic representations of gamma ray logs plotted against depth in feet. FIG. 2 shows an offset log, while FIG. 3 illustrates a log from a borehole which is navigated through a stratigraphic zone using the method of the present invention, in accordance with a preferred embodiment.

FIG. 4 shows a schematic representation of a borehole drilled within a stratigraphic target zone.

FIGS. 5A-5B illustrate portions of the gamma log of FIG. 3, plotted against true stratigraphic depth of the target zone. FIG. 5A illustrates a continuous downward traversal of the borehole relative to the stratigraphy. FIG. 5B illustrates a continuous upward traversal of the borehole.

FIGS. 6–9D illustrate an example of borehole navigation with the present invention. FIG. 6 is an offset log. FIG. 7 is a log of the borehole being drilled, and FIGS. 9A–9D are logs relative to true stratigraphic depth. All logs are gamma ray versus depth in feet. FIG. 8 is a schematic representation of a vertical section of the borehole and the target zone.

DESCRIPTION OF THE PREFERRED EMBODIMENT

Figure 1:
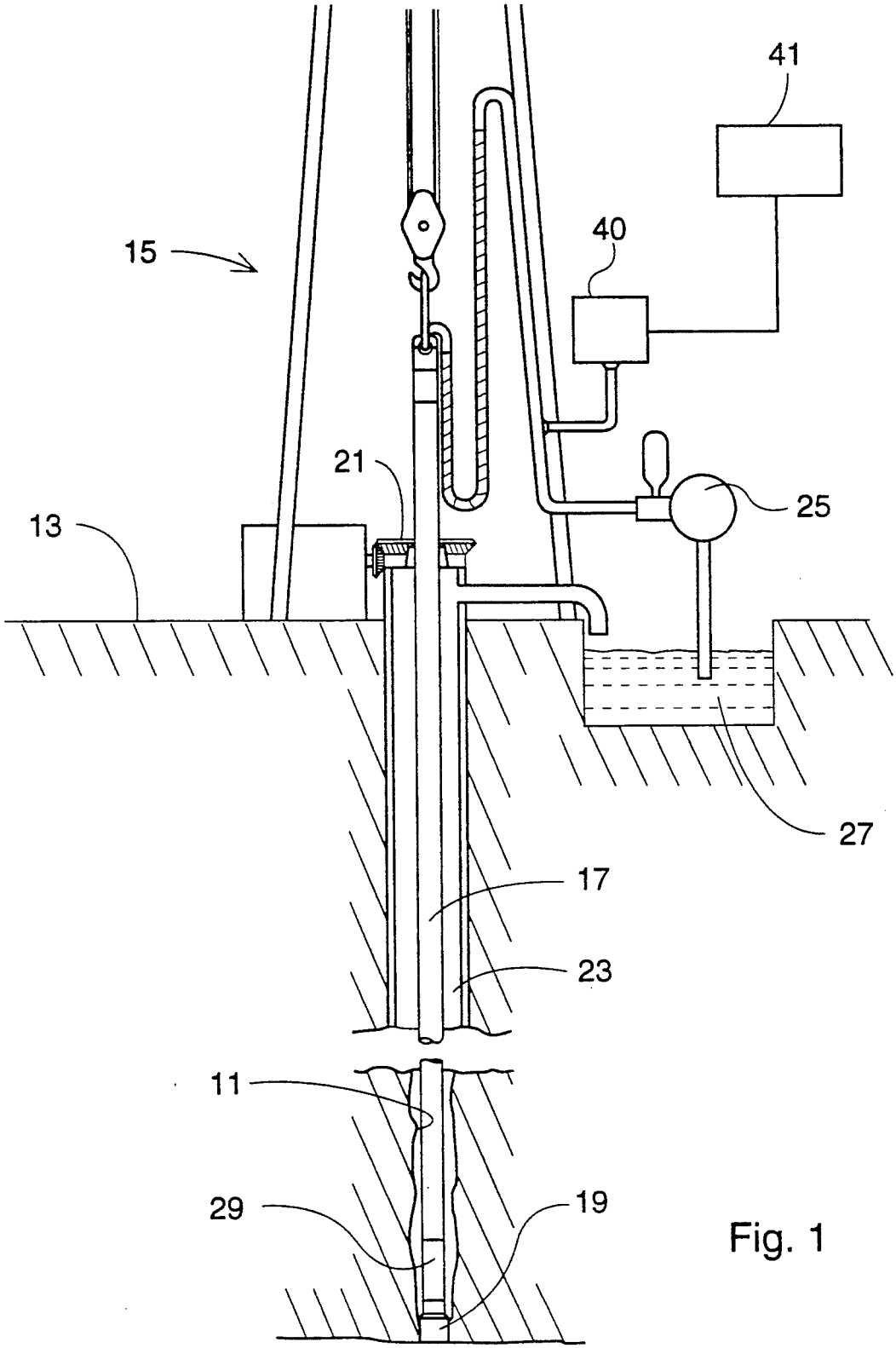
FIG. 1 is a schematic view of drilling equipment and a borehole.

In FIG. 1, there is shown a schematic representation of drilling equipment and a borehole 11 drilled into the earth 13 in search for oil. The borehole is drilled using conventional drilling techniques including directional drilling techniques. Such techniques are well known and will be briefly described herein to provide background information on how a borehole is drilled in a desired direction.

A well drilling rig 15 is located on the surface. A string of drill pipe 17 extends from the drilling rig 15 into the borehole 11. At the downhole end of the drill pipe is a bit 19. A rotary table 21 on the rig 15 rotates the entire string of drill pipe 17. This rotary action, along with putting the weight of the drill pipe 17 on the bit 19, results in drilling and extending the borehole through the earth. Drilling mud is circulated downward through the interior of the drill pipe 17. The mud exits the drill pipe at the bit 19, where it carries the cuttings from the drilling operations uphole by way of the annulus 23 between the drill pipe 17 and the walls of the borehole 11. A mud pump 25 is provided on the surface to circulate the mud through the drill pipe an back into a mud pit 27.

As the bit cuts into the earth, the string of drill pipe 17 is lengthened by adding sections of drill pipe to the uphole end. The length of each drill pipe section is known. Thus, the length of the borehole 11 can be measured by counting the number of drill pipe sections that are used to make up the drill string.

Rotating the drill bit from the surface with the rotary table 21 results in drilling the borehole in a more or less downward direction. To drill the borehole in a more horizontal direction, the bit 19 is rotated by a mud motor 29 located close to the bit or by rotation of the drill string or by both rotation of the drill string and use of a mud motor. The motor 29 is powered by the flow of mud therethrough, which turns the bit. The drill bit is rotated through the use of a bent sub connecting the motor 29 and the bit 19 to the drill pipe 17. The use of the bent sub causes the path of the borehole to curve from a generally straight direction. The direction of the borehole is controlled by adjusting the amount and orientation of the bent sub, and the weight on the bit.

For example, when drilling a borehole to tap into a stratigraphic zone located thousands of feet below the surface, the borehole is initially drilled in a generally downward or vertical direction. The rotary table 21 is used to rotate the drill pipe 17 during this initial phase of drilling. When the borehole nears the zone, the mud motor 29 can be used to change the direction of the borehole from downward to near horizontal. As the borehole is drilled or extended further, changes in direction of the borehole can be made using the mud motor. The borehole may be drilled in an upwardly direction, a downwardly direction or be turned to the side.

The present invention takes advantage of directional drilling techniques and capabilities that allow a borehole to be drilled in any direction that is desired. The present invention relates the location of the borehole to the location of a target stratigraphic zone. This allows the borehole to be drilled for an extended distance inside of the target zone. The borehole thus stays within the target zone for extended distances.

The first step of the method of the present invention is to determine identifying characteristics of the target zone, which is the stratigraphic zone of interest. In the preferred embodiment, the identifying characteristics are determined from an offset gamma ray log 35 (see FIG. 2). The log 35 is plotted with depth of the borehole along the vertical scale and gamma ray units (typically expressed as counts per second (CPS) or API units) along the horizontal scale. Thus, there is a gamma ray measurement at each depth. The gamma ray log 35 is obtained with conventional logging techniques.

The identifying characteristics can be obtained in a variety of ways. For example, an offset log can be obtained from a previous borehole or well such as an offset borehole, which is a vertical borehole penetrating the target zone at a location near the current borehole that is being drilled, a nearby horizontal well, or a vertical well. Offset logs may be obtained from these other boreholes and wells. Alternatively, the offset log can be obtained while drilling the borehole of interest. Real time logging can be used, wherein logging data is transmitted to the surface from near the drill bit with conventional measuring while drilling techniques. In measuring while drilling, the gamma ray sensor is located near the drill bit. During drilling, the sensor acquires data from the formations surrounding the borehole. The data is telemetered up to the surface by creating pressure pulses in the circulating mud. The pressure pulses in the mud are detected at the surface by a transducer 40 (see FIG. 1) and processed by a processor 41 to extract the gamma ray data. The borehole, which is a pilot hole, can be drilled so as to penetrate completely through the target zone in order to obtain the offset log. After obtaining the offset log, the drill bit is raised up to a location above the target zone. Directional drilling techniques are then used to drill a branch borehole into the target zone. For the description that follows, it will be assumed that the offset log 35 has been obtained from a nearby well or borehole.

It is preferable that the offset log be obtained from a well or borehole that is as near to vertical as practical. A vertical offset log exhibits little or no distortion along the length of the borehole and provides a good reference. If the offset borehole is inclined somewhat from the vertical, e.g. 2 or 3 degrees, then the true vertical depth of selected points along the log can be determined. Knowledge of the degree of inclination from the vertical of the borehole is obtained from logging information.

The gamma ray offset log 35 exhibits a character which is representative of the strata along the length of the borehole. The character of the log comprises the peaks and valleys, their magnitudes, their sequence and their spacing. To simplify the discussion that follows, the character of a log is analyzed in terms of peaks. A geoscientist or geophysicist interprets the character of the log to correlate strata to oil bearing formations as determined by other logging methods. Thus, an oil bearing target zone can be identified relative to strata. Examples of interpretation are: a target zone being located between two or more peaks, a target zone extending from a single peak in either the up or down direction, or a target zone being offset some distance from one or more peaks. For the log of FIG. 2, there are the following peaks: A, B and C. For the description that follows, an example that locates the target zone as extending between peak A and peak C will be used.

Once the identifying characteristics of the target zone are determined, the well or borehole of interest is drilled (assuming that the identifying characteristics have been obtained from another well or borehole). While drilling the borehole, the approximate depth of the target zone is known from the offset log 35. However, the target zone usually lies at a different depth in the borehole being drilled. This is due to several factors. For example, the offset well may lie at some distance from the borehole being drilled. In addition, strata tend to lie at an angle to the horizontal, which orientation is referred to as dip. Thus, the strata could dip up or down in the distance between the offset well and the borehole being drilled. Also, faulting between the offset well and the borehole being drilled could shift the strata either up or down.

The next step is to obtain a log of the borehole being drilled, which can be related to the offset log for navigational purposes. During the drilling of the borehole, a gamma ray log 37 is obtained, as shown in FIG. 3. FIG. 3 shows a gamma ray log with measured depth along the borehole (that is the length of the borehole) as the vertical axis and gamma ray units along the horizontal axis. The log can be obtained in a variety of conventional and commercially available manners. For example, the log can be obtained in real time using measuring while drilling techniques. Another technique for acquiring the log is to pump down the gamma ray sensor through the interior of the drill pipe. The gamma ray data is then acquired through the drill pipe. Still another technique is to drill for a short period of time and then stop drilling. The drill bit is brought out of the borehole and the gamma ray (or other type) logging tool is attached to the end of the drill pipe and pushed to the end of the borehole. The data log is acquired by the logging tool, while moving the tool along the borehole, after which the logging tool is brought out of the borehole. The drill bit is then reinserted into the borehole and drilling is resumed.

Selected points along the length of the borehole being drilled are then related to the offset log 35. These points are referred to as correlation points. Each correlation point has the following parameters: X offset (measured from some reference X, with east offsets from the reference X being positive and west offsets from the reference X being negative), Y offset (measured from some reference Y, with north offsets from the reference Y being positive and south offsets from the reference Y being negative), true vertical depth (TVD) as measured from the surface (this is the Z offset), and the value from the gamma ray log at the correlation point. The X offset, Y offset and TVD are obtained from the known length of the borehole, along with conventional logging techniques that allow the location of the drill bit relative to a reference point to be determined.

The location of the borehole relative to the surrounding stratigraphy, and thus the target zone, is determined. This is accomplished by determining a true stratigraphic depth (TSD) for each correlation point. The true stratigraphic depth determines the location of the target zone relative to the location of the correlation point and thus of the borehole. The spatial position (X offset, Y offset, TVD) of the correlation point is known. By determining the location of the target zone relative to the borehole, the direction that the borehole is drilled next can be determined so as to locate the borehole within the target zone, or if the borehole is already in the target zone, then so as to maintain the borehole within the target zone.

The true stratigraphic depth equals the true vertical depth for those correlation points that are between the surface and the first correlation point. After the first correlation point, true stratigraphic depth is determined by correlating the correlation point data to the offset log 35 of FIG. 2.

With the log of FIG. 3, there are shown four correlation points, each of which is taken at a gamma ray peak (correlation points need not be obtained at peaks). Correlation point 1 has the following values: $X_1$, $Y_1$, $TVD_1$ and a gamma ray value of peak A'. Correlation point 2 has the following values: $X_2$, $Y_2$, $TVD_2$ and a gamma ray value of peak B'. Correlation point 3 has the following values: $X_3$, $Y_3$, $TVD_3$ and a gamma ray value of peak C'. Correlation point 4 has the following values: $X_4$, $Y_4$, $TVD_4$ and a gamma ray value of peak D, By correlating the log 37 to the offset log 35, it is determined that correlation point 1, with its peak A', has the same true stratigraphic depth as peak A of the offset log 35. This is to say that correlation point 1 is the same rock layer or the same boundary between rock layers as characterized by peak A of the offset log. Likewise, correlation point 2, with its peak B', has the same true stratigraphic depth as peak B, and correlation point 3, with its peak C', has the same true stratigraphic depth as peak C. Thus, it is determined that the true stratigraphic depth of correlation point 1 is less than the true stratigraphic depth of correlation point 2, which in turn is less than the true stratigraphic depth of correlation point 3. Also, the true stratigraphic depth of correlation point 4 is less than the true stratigraphic depth of correlation point 3. In fact, the true stratigraphic depth of correlation point 4, with its peak B', equals the true stratigraphic depth of correlation point 2.

Assuming that the stratigraphic thickness is constant, lines of constant true stratigraphic depth can be determined from knowledge of X, Y, TVD and TSD for each correlation point (see FIG. 4). Thus, there is shown a line A that corresponds to peaks A and A', line B that corresponds to peaks B and B' and line C that corresponds to lines C and C'. Also shown is the determined location of the borehole 11 relative to the lines of equal stratigraphy. Each line of constant TSD represents a stratum or a boundary between strata and need not represent the boundary of a target zone. The lines represent identifiable characteristics of the stratigraphy traversed by the borehole. The target zone may be represented by an offset from a line of constant TSD.

The true stratigraphic depth of other points can be determined for interpolation purposes. For example, a point 5, shown in FIG. 3, lies between correlation points 1 and 2. The true vertical depth of point 5 is known from the logging data. The true stratigraphic depth of point 5 equals the true stratigraphic depth of correlation point 1 plus the difference in true vertical depths of correlation point 5 and of strata A located directly above point 5. Using the true vertical depth of strata A directly above point 5 accounts for the dip in strata A between points 1 and 5. Likewise, for a point 6, which is located between points 3 and 4, the true stratigraphic depth equals the true stratigraphic depth of correlation point 3 minus the difference in true vertical depths of correlation point 6 and of strata C located directly below point C.

Once the true stratigraphic depth is determined, then for each point along the borehole, the gamma ray data is displayed versus true stratigraphic depth (TSD), as shown in FIGS. 5A and 5B. In FIG. 5A, the down segment of the borehole gamma ray log is shown. Comparing FIG. 5A to FIG. 2, it is seen that the logs appear similar. Comparing FIG. 5B to the lower portion of FIG. 2, the logs also appear similar. If the target zone is between stratigraphic boundaries A and C, for example, then the borehole would stay within the target zone. Thus, the accuracy of the borehole navigation and placement is good.

Figure 6:
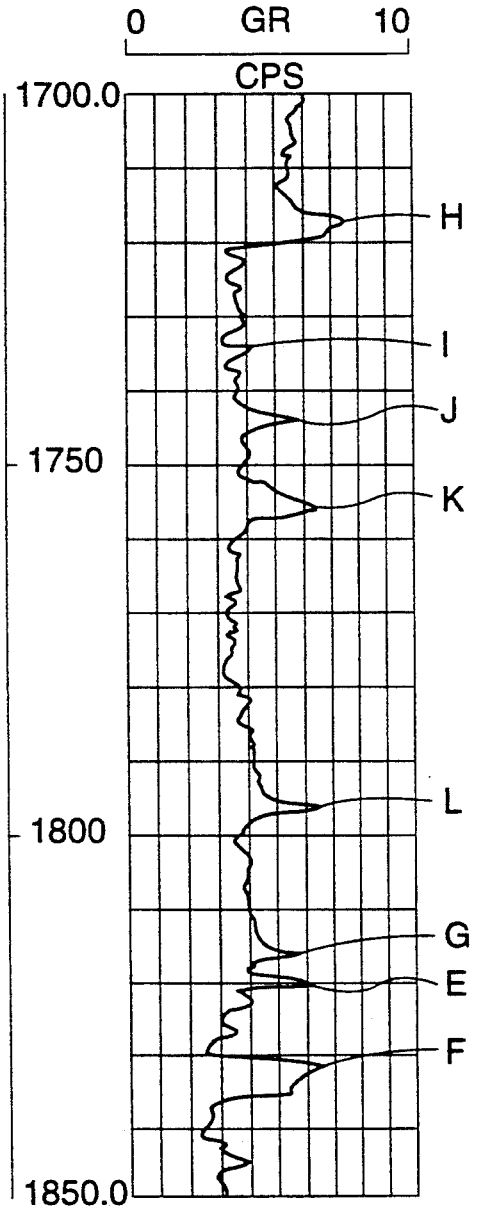

Referring now to FIGS. 6–9, an example of the method of the present invention will be described. FIG. 6 shows an offset log. An interpretation of the offset log determines that a target zone is approximately located between peak E at 1820 feet and another peak F at about 1830 feet. The first peak E can be further identified by its proximity to a third peak G located above peak E. In addition, other characterizing information from the log can be used to identify the target zone. Based on the interpretation, the stratigraphic target zone has a thickness of about 10 feet.

As the borehole of interest is drilled, a log (shown in FIG. 7) is obtained along the length of the borehole. As the borehole is extended from about 1800 feet to 2000 feet in length, several peaks are detected. These peaks are correlated to peaks H, I, J, K and L from the offset log of FIG. 6. This information indicates to the driller that the borehole (and specifically the bottom of the borehole) is nearing the target zone. The driller can then begin to turn the borehole towards a horizontal orientation.

Figure 7:
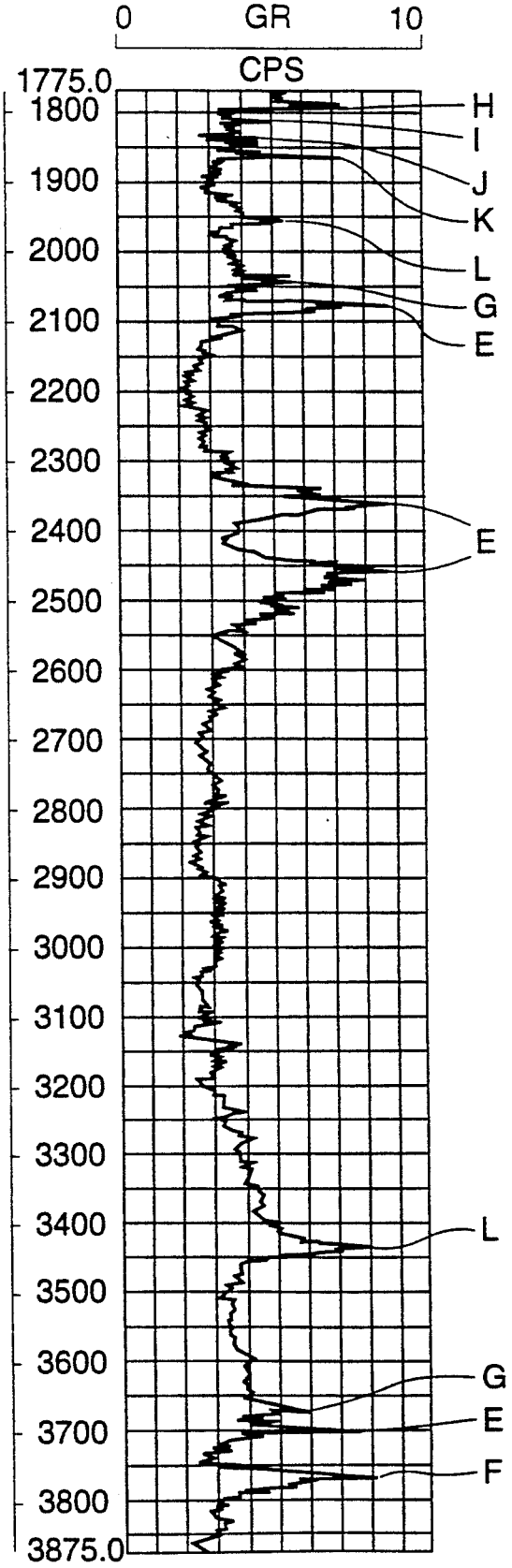

As the length of the borehole nears 2100 feet, two more peaks on the borehole log of FIG. 7 are detected. These are correlated to peaks G and E on the offset log of FIG. 6. Peak E marks the upper boundary of the target zone. The orientation of the borehole is changed so that as the length of the borehole nears 2200 feet, the bottom portion of the borehole is horizontal or proceeding at an estimated dip.

Next, the true stratigraphic depth (TSD) of various correlation points along the length of the borehole is determined by correlation to the offset log of FIG. 6. The correlation determines, among other things, the following: peak E is at about 2075 feet of the log of FIG. 7; peak E occurs again at about 2360 feet and again at about 2450 feet; peak L occurs at about 3430 feet; peak E at about 3700 feet and peak F at about 3760 feet.

Figure 8:
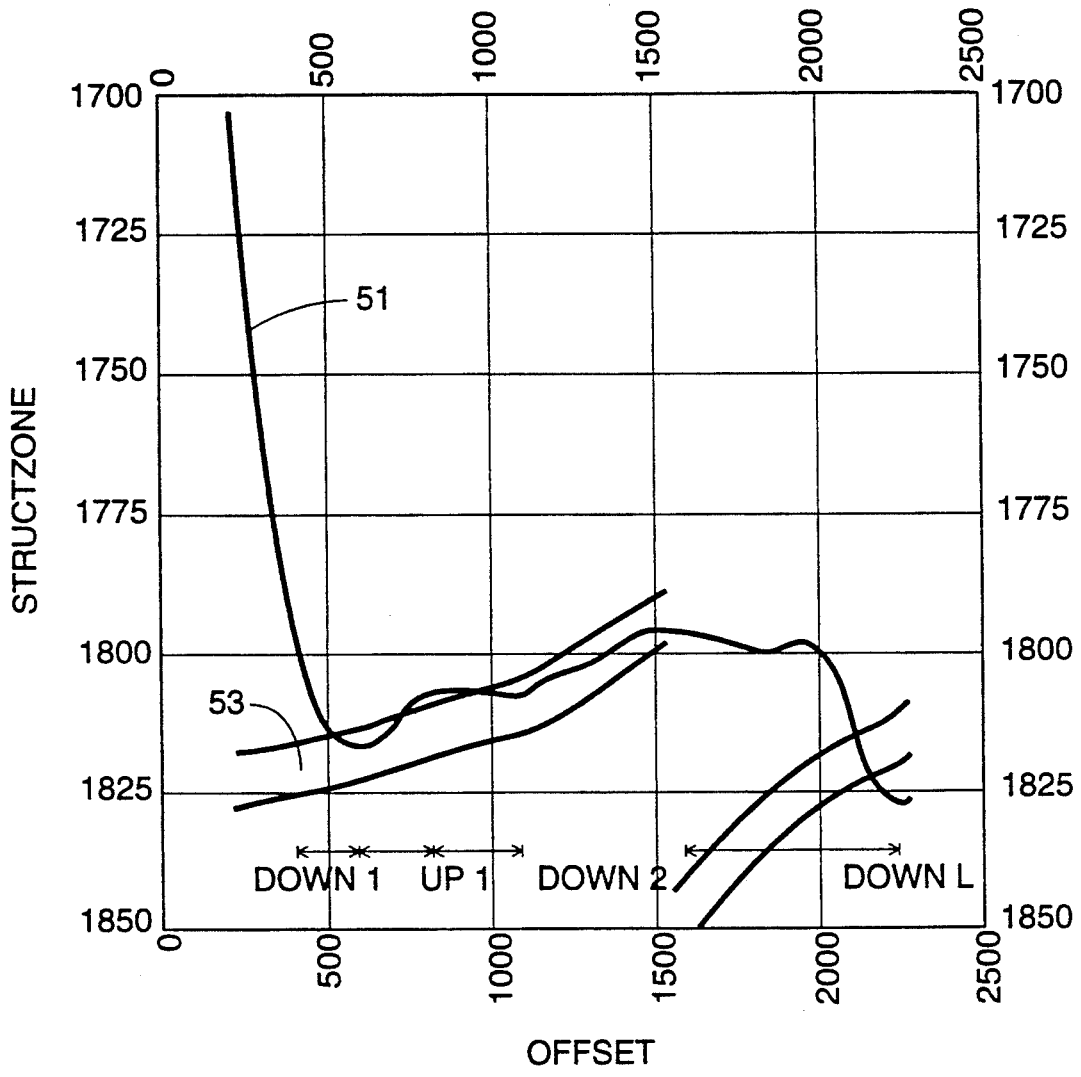

Referring to FIG. 8, a schematic representation of the borehole relative to the target zone is shown. The information needed to construct the representation of FIG. 8 was obtained from correlation points and their true stratigraphic depths along the borehole length. From the surface to about 2170 feet (measured along the length of the borehole), the borehole 51 traverses downwardly through the strata, entering the target zone 53 (about 500 feet along the offset scale) and proceeding parallel to strata for a short distance. From about 2170 feet (along the borehole length) to 2430 feet, the borehole traverses upwardly through the strata, and in fact, exits the top boundary of the target zone. From about 2430 feet to 2700 feet, the borehole traverses downwardly through the strata, reentering the target zone. From about 2700 feet to 3150 feet, the borehole stays within the target zone and gradually progresses downward within the zone. After about 3150 feet (about 1500 feet along the offset scale), the borehole crosses a fault, as evidenced by the reappearance of peak L at about 3430 feet. This indicates that the borehole is located above the target zone. The borehole is then directed downwardly from about 3140 feet to 3875 feet. The borehole traverses downwardly through the target zone from about 3700 feet to 3760 feet.

The vertical scale of FIG. 8 is exaggerated relative to the horizontal scale. Thus, the target zone appears at first glance to be thick relative to the horizontal length. However, a more careful review of FIG. 8 shows that the borehole stayed within a stratigraphic zone that was 10 feet thick for about a thousand feet (from 500 feet along the offset scale to 1600 feet). The borehole missed the target zone by a few feet when it exited the top boundary. This accuracy in navigating a borehole through a stratigraphic zone is truly remarkable, especially when it is realized that the stratigraphic zone does not extend in a straight line. The stratigraphic zone changes its dip during the traversal of the borehole through the zone. In addition, after the fault, the borehole traversed the 10 foot target zone for a distance of about 60 feet before exiting the target zone.

Figures 9A, 9B, 9C, 9D:
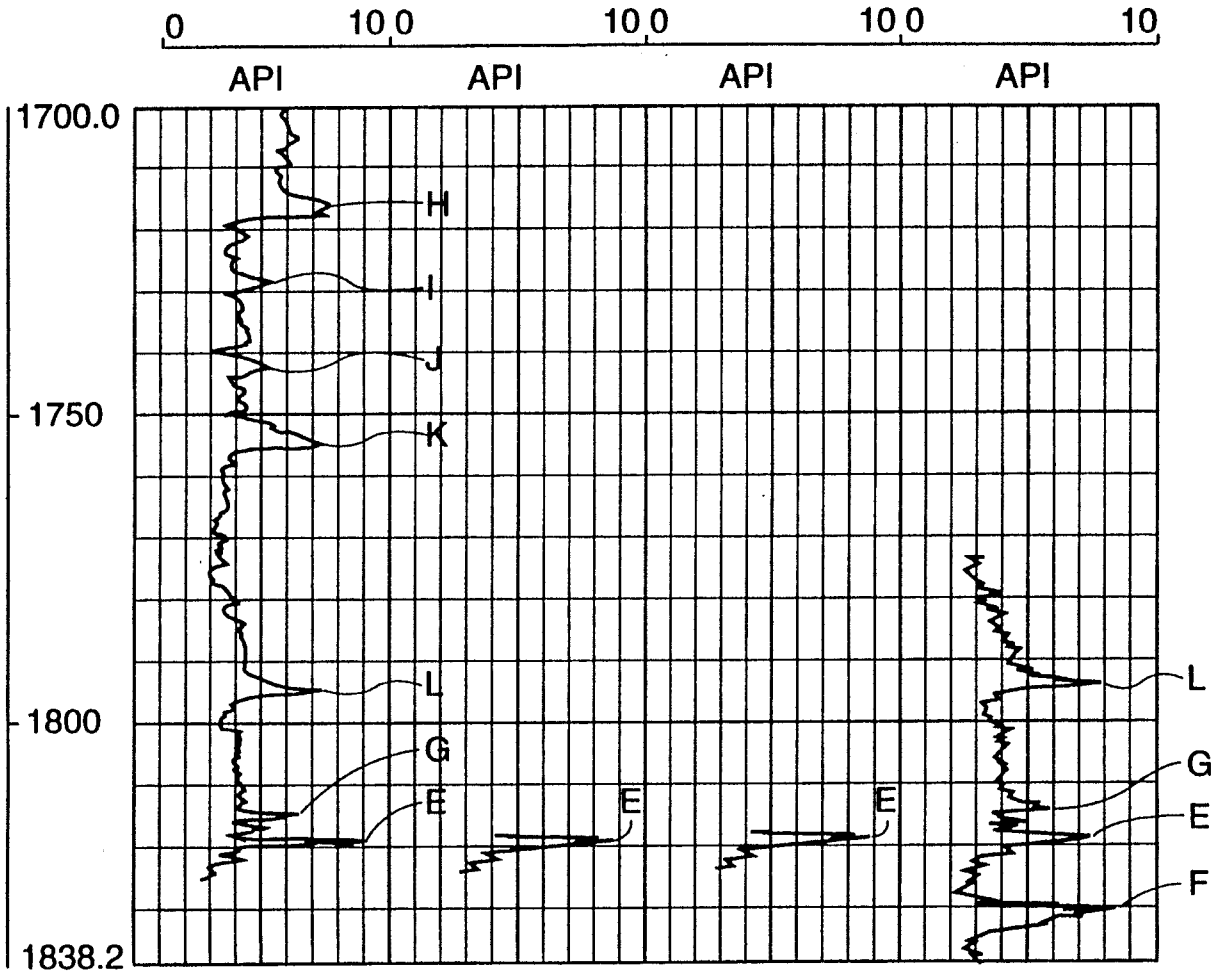

FIGS. 9A–9D show segments of the log (from FIG. 7) of the borehole plotted against true stratigraphic depth. FIG. 9A shows the first downward traversal (DOWN 1) relative to the strata. The segment of the borehole identified as DOWN 1 is indicated on FIG. 8. FIG. 9B shows the first upward traversal (UP 1) relative to the strata. FIG. 9C shows the next downward traversal (DOWN 2), while FIG. 9D shows the last downward traversal (DOWN L). These Figs. are used to judge the accuracy of the navigation and the accuracy of the representation of FIG. 8. These Figs. are close to the offset logs of FIG. 6, indicating an accurate navigation.

Although the identifying information has been described in terms of a gamma ray log, other types of information can be used. For example, a very shallow reading resistivity log could be utilized to provide characterizing information that distinguishes the stratigraphic zone of interest from other strata. In the alternative, more than one type of information can be utilized. For example, both a gamma log and a resistivity log can be used together. A very shallow reading resistivity log generally shows faults in a clear manner, while a gamma log is most representative of stratigraphy. Other types of information that can be utilized include a neutron log, a density log, a sigma capture cross section log, and a sonic or acoustic log. All of these logging techniques are conventional in the industry and are commercially available.

Although the present invention has described the acquisition of logging data, the method can be practiced with logging data that has already been obtained. The method processes the existing logging data. For example, offset logs can be purchased from logging companies or may be contained in a data library. Likewise, when drilling a borehole, a logging company may be on site to obtain the logging information. The method can be practiced using real time logging information, or it can be practiced using previously acquired logging information.

The foregoing disclosure and the showings made in the drawings are merely illustrative of the principles of this invention and are not to be interpreted in a limiting sense.

We claim:

1. A method of determining the location of a borehole relative to strata in the earth, comprising the steps of:

a) providing information from said borehole, which information characterizes said strata;

b) providing characterizing information of said strata from an offset location; and c) comparing said characterizing information from said borehole to said characterizing information from said offset location to determine the location of selected points along said borehole relative to said strata.

2. The method of claim 1 further comprising the step of directing extensions of said borehole using the location of said points relative to said strata.

3. The method of claim 1 wherein:

a) said step of providing information from said borehole that characterizes said strata further comprises the step of providing a borehole gamma ray log; and b) said step of providing information of said strata from an offset location further comprises the step of providing an offset gamma ray log.

4. The method of claim 1 wherein said step of providing information from said borehole that characterizes said strata further comprises the step of providing a borehole gamma ray log.

5. The method of claim 1 further comprising the step of displaying said characterizing information relative to said strata.

6. A method of determining the location of a borehole in the earth, comprising the steps of:

a) providing characterizing information of the earth from an offset vertical location;

b) providing characterizing information of the earth from along the length of said borehole;

c) rescaling said borehole characterizing information onto a vertical scale; and d) comparing said rescaled borehole characterizing information to said offset characterizing information to determine the location of said borehole within said earth.

7. The method of claim 6 wherein said steps of providing offset characterizing information and borehole characterizing information further comprises the steps of providing an offset gamma ray log and a borehole gamma ray log.

* * * * *